United States Patent [19]

Traczyk et al.

[11] B 3,983,729

[45] Oct. 5, 1976

[54] METHOD AND APPARATUS FOR NECKING AND FLANGING CONTAINERS

[75] Inventors: Edward S. Traczyk, Oak Lawn, Ill.; Jack Quinton; Walter C. Warnell, both of San Jose, Calif.

[73] Assignee: National Can Corporation, Chicago, Ill.

[22] Filed: Feb. 3, 1975

[21] Appl. No.: 546,631

[44] Published under the second Trial Voluntary Protest Program on February 3, 1976 as document No. B 546,631.

[52] U.S. Cl. ..... 72/43; 72/94; 113/115; 113/1 G

[51] Int. Cl.[2] ..... B21D 51/26

[58] Field of Search ..... 113/1 G, 115; 72/43, 72/68, 94, 123, 405; 118/230, 232, 239

[56] References Cited

UNITED STATES PATENTS

| | | | |
|---|---|---|---|
| 2,642,031 | 6/1953 | Lager et al. | 118/232 |
| 3,033,264 | 5/1962 | Henrickson | 113/115 |
| 3,260,089 | 7/1966 | Hazelton et al. | 113/115 |
| 3,807,209 | 4/1974 | Aschberger | 113/115 |
| 3,831,416 | 8/1974 | Wolfe | 113/1 |
| 3,857,265 | 12/1974 | Howeler et al. | 113/115 |

*Primary Examiner*—Lowell A. Larson
*Attorney, Agent, or Firm*—James E. Anderson; Ralph R. Rath

[57] ABSTRACT

A method and apparatus for producing a reducing neck and a peripheral flange on a free peripheral edge portion of a cylindrical container body is disclosed herein. The apparatus consists of a fixed frame having a waxing station, a necking station, and a flanging station defined thereon. The containers are fed from a source in a synchronized fashion along a path with the axis of the cylindrical bodies of the containers extending vertically and are moved past the waxing station where the cans are rotated relative to fixed brushes to apply lubricant to the outer surface of the peripheral free edge portion. The reduced neck on the container is produced by supporting the containers on a bottom member that is carried on the periphery of a turret and an upper member having an annular die with the bottom member being cammed towards and away from the die to produce the reducing neck of the container. The flanging of the container is accomplished with a flanging turret having a plurality of flanging assemblies on the periphery thereof each of which consists of an upper member that is rotated about a fixed axis in a sleeve on the turret and a lower member that is reciprocated towards and away from the upper member by cam means.

50 Claims, 11 Drawing Figures

20
22
24
26
30
31
32
38
40
41
42
44
46
48
50
52
54
60
62
64
110
112
114
120
122
124
126
128
140
142
160
162
230
246
308
354
500
502
504
506
508
509
550
552
554

100
102
106
104
104
92
86
84
82
74
94
80
80
96
72
70
30
76
70
41
40
98
110
112
38
88
20

162
302
308
311
304
340
342
334
300
330
331
331
334
310
314
314
9.
9.
350
354
352
324
324
320
312
322
322
328
328
311
326
327
327
329
410
326
332
306
311
520
8.
8.
510
522
530
530

METHOD AND APPARATUS FOR NECKING AND FLANGING CONTAINERS

BACKGROUND OF THE INVENTION

For many years, a standard container in the beer and beverage industry has been a can of so-called three-piece construction which consists of a cylindrical body that is formed by rolling a flat blank into a cylinder, interlocking the edges of the blank and soldering the edges to produce a cylindrical body. Two end panels are then attached to opposite ends of the cylindrical body by a double seaming process.

The quite recent alternate to the three-piece container is what is commonly referred to as a two-piece container. In forming a two-piece container, a metal blank is impact extruded or deep drawn to produce a cylindrical body and an integral bottom end wall. In this type of container, the second piece of the two-piece container consists of an end panel that is separately formed and attached to the upper end of a cylindrical body by a double seaming process. A container manufactured according to this process has a larger outside diameter along the upper edge where the double seaming operation has been performed than the diameter of the remainder of the container. Thus, when cans such as these are placed in a multi-pack carrier, such as a so-called six-pack carton which grips the upper double seam, the package, when viewed from the end, is slightly trapezoidal in shape. This, of course, results from the larger outside diameter of the double seam at the top of the containers.

To overcome this problem, some beer and beverage containers are being manufactured with a reduced diameter neck portion that is produced on the upper free edge of the integral body and bottom wall so that when a double seam is formed, the outer edges of the seam are approximately parallel or flush with the outer peripheral surface of the remainder of the can body. This provides a more compact packing of cans which in turn lowers the total shipping and storage costs. Because of the reduced cost and the pleasing esthetics of these types of containers, the demand for containers of this type is substantial and is continually increasing.

Because of the increase demand, considerable efforts have been devoted to producing apparatus which is capable of producing the reducing neck and the peripheral flange on a container body. Heretofore, it has been customary for the necking and the flanging operation to be performed by completely separate machines. One type of apparatus for producing the reducing neck consists of an annular die that is used to engage the peripheral surface of the free edge portion of the container body while the container is supported at the bottom. When using this type of necking apparatus, it is necessary that a lubricant be applied to the peripheral edge portion of the container before the reducing neck is formed by the annular die.

In the past, it has been customary for the lubricant to be applied by a separate apparatus and the can then fed from the lubricant applying machine to a necking machine through a chute. The containers are normally in a position where the axis of the cylindrical body is generally horizontal so that the container can be fed into the necking apparatus by gravity through a chute extending from the lubricant applying means or waxer to the necking apparatus. After the containers have the reducing neck produced thereon, they are again gravity fed through chutes from the necking apparatus to a separate flanging apparatus where the outwardly directed flange is produced thereon.

One of the problems encountered with an operation of this type is the amount of floor space that must of necessity be utilized for the separate machines. Furthermore, in order to rely upon gravity transfer of the containers between the machines, the lubricant applying machine must be supported at a substantial elevation above the floor of a building housing the apparatus while the necking apparatus must also be supported by frame structure above the floor.

An additional problem encountered with heretofore known method and apparatus for producing a neck and a flange on a container body is the fact, when relying upon gravity feeding, the containers are continuously subjected to possible damage, such as denting, while they are being transferred from one location to another. This problem is particularly acute when the containers are formed of thin gage aluminum.

A further problem with the previously known method of waxing, necking and flanging the open end of a drawn and ironed container is that the speed of operation is to some extent limited.

SUMMARY OF THE INVENTION

According to the present invention, containers are lubricated or waxed, necked and then flanged in a continuous operation wherein the cans are at all times completely controlled by the apparatus. The apparatus for accomplishing this consists of a single frame that has a waxing or lubricating station, a necking station, and a flanging station defined thereon with the containers being transferred between the respective stations through positive transfer mechanisms that at all times maintain complete control of the container so that the containers are always supported and driven in a positive fashion. One advantage of the particular apparatus of the present invention is that the amount of floor space required for the waxing, necking and flanging operation is substantially reduced. Another advantage is that the possibility of denting the container bodies is substantially reduced.

More specifically, the apparatus of the present invention consists of a conveyor that moves the containers in synchronized fashion along a predetermined path with the axis of the cylindrical body extending generally vertically. A lubricant applying station is located adjacent the inlet to the path and consists of brushes that are vertically aligned with upper free edge portions of the cylindrical containers and rotating means for rotating the containers relative to the lubricant applying brushes. The containers are then positively moved in synchronized fashion from the lubricating station to a necking station where a reducing neck is formed on the free edge portion of the cylindrical container body. The necking portion consists of an upper member that has an annular die for engaging the outer surface of the edge portion and a lower member for engaging the bottom of the cylindrical container body and a camming mechanism for reciprocating the lower member relative to the upper member. The containers with the reducing neck are then transferred by a transfer wheel, forming part of the conveyor means defining the path, to a flanging station wherein an outwardly directed flange is produced on the free edge of the reducing neck. The flanging station has an upper member for engaging the inner surface of the reducing neck and a lower supporting member which is elevated towards and away from the upper member while the upper member is continuously rotated to produce the outwardly directed flange on the upper edge of the container. The necked and flanged container is then positively moved from the flanging station by a further transfer wheel, defining a part of the conveying means.

More specifically, the necking station consists of a turret that has a plurality of necking assemblies defined on the outer periphery thereof. Each necking assembly consists of upper and lower vertically aligned sleeves that respectively support an upper necking member and a lower support member. The lower support member is reciprocated within the lower sleeve towards and away from the upper necking member by a cam carried on the respective members and engaging a camming surface defined on the fixed frame. The necking station has means for removing the containers from the necking member or die.

The flanging station also consists of a flanging turret rotated about a fixed vertical axis with a plurality of flanging assemblies supported on the outer periphery thereof. Each flanging assembly again consists of upper and lower sleeves that are vertically aligned with each other and respectively support an upper flanging member and a lower support member. The upper flanging member has flanging rollers on the lower edge thereof that are freely rotatable thereon and the entire flanging member is positively rotated about the axis of the sleeve through a fixed gear on the frame and a gear connected to each flanging member and in mesh with the fixed gear. The lower member or supporting member is adapted to be raised and lowered relative to the upper member by cam means interposed between the member and the fixed frame for positively moving the containers towards and away from the flanging rollers.

According to one aspect of the invention, the spacing of the containers is synchronized adjacent the inlet to the path and all of the driven members are driven by a common power source which is connected to the respective members, such as the turret and the transfer wheels with adjustable connections so that the containers are positively driven throughout the path of movement and the spacing between the containers is accurately maintained.

DETAILED DESCRIPTION

Figure 1:
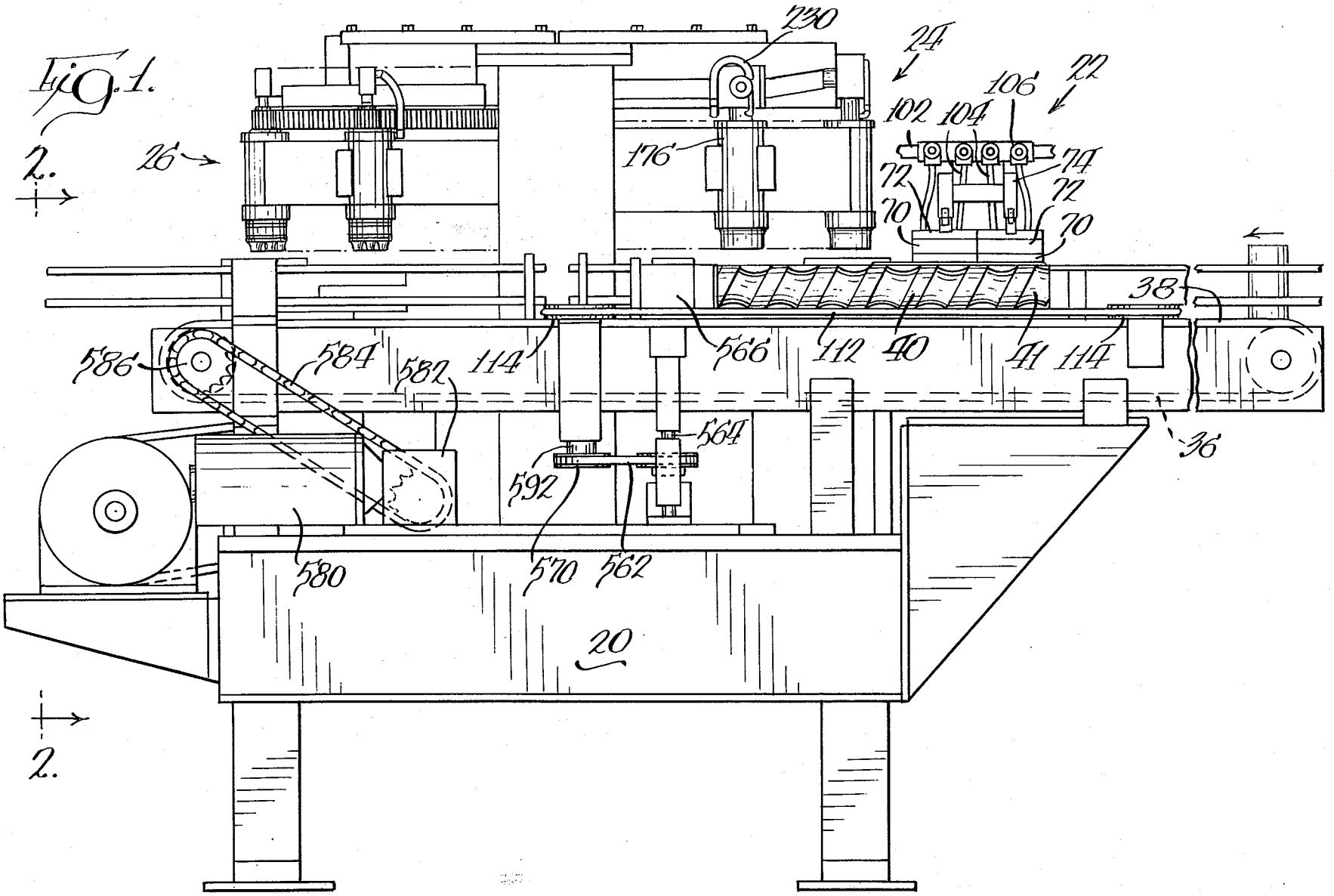
FIG. 1 of the drawings shows a side elevation view of the waxing, necking and flanging apparatus of the present invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

GENERAL DESCRIPTION

Figure 2:
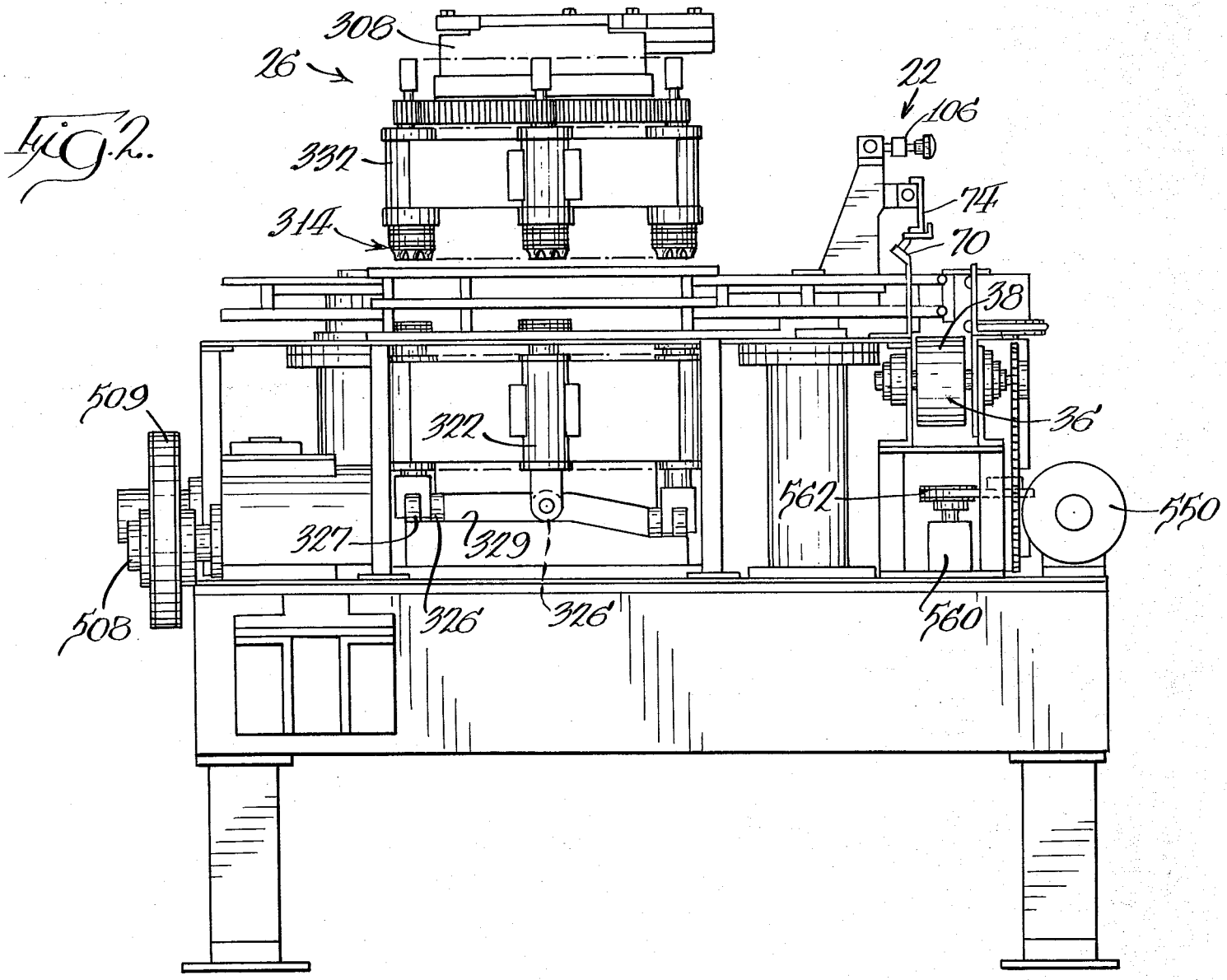
FIG. 2 is an end elevation view, as viewed along line 2—2 of FIG. 1.
Figure 3:
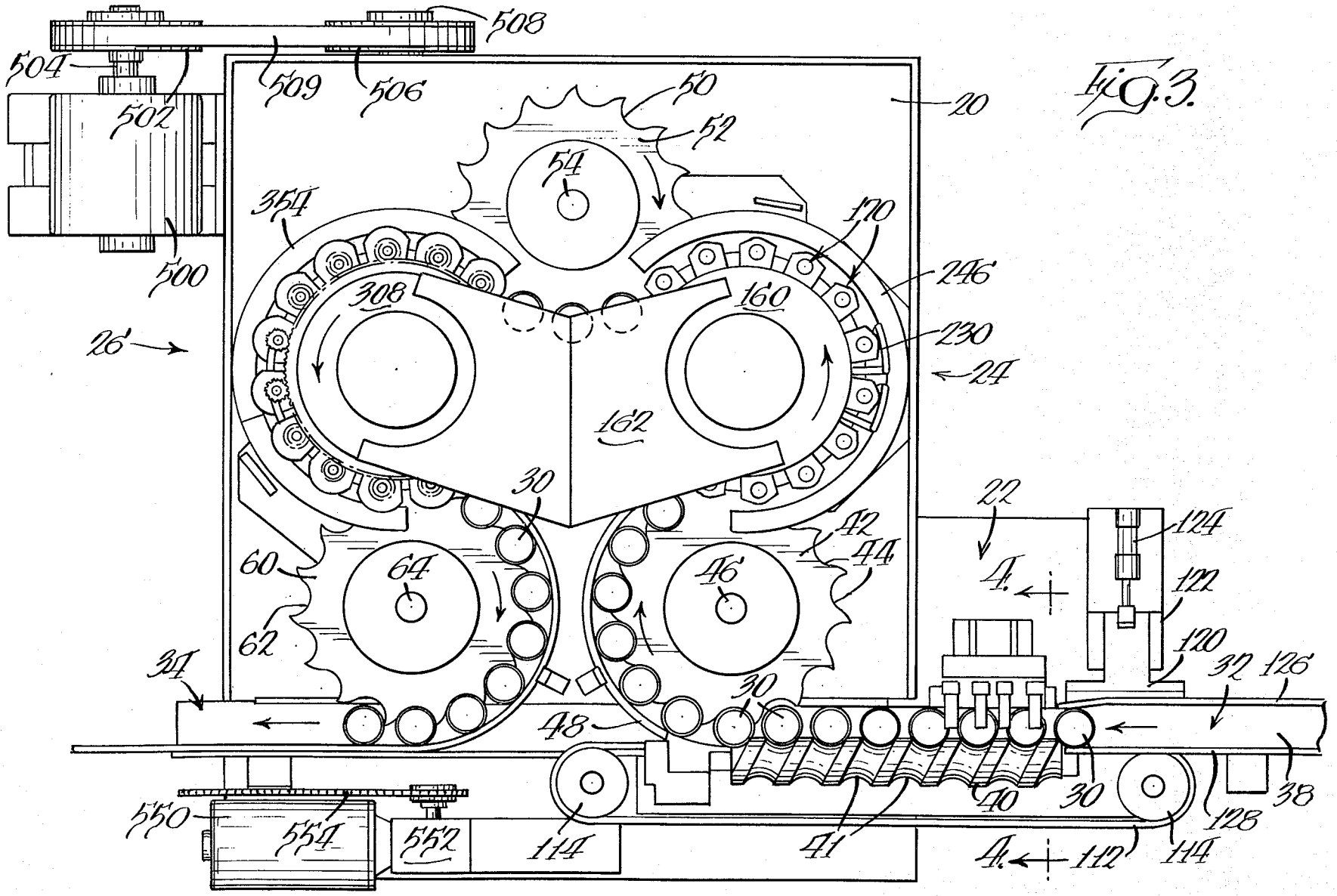
FIG. 3 is a plan view of the apparatus.

FIGS. 1, 2 and 3 show the overall arrangement of the waxing, necking and flanging apparatus constructed in accordance with the teachings of the present invention. The apparatus consists of a single base or frame 20 that has a lubricating or waxing station 22, a necking station 24 and a flanging station 26 with conveying means for moving the containers along a generally horizontal path.

Conveying Means

According to one aspect of the invention, the conveyor means is designed to be able to positively move containers 30 from inlet end 32 to outlet end 34 while at all times maintaining positive control of the movement of the container 30. For this purpose, an endless conveyor belt 36 (FIGS. 1 and 2) has an upper flight 38 which defines inlet 32 (FIG. 3) for the path as well as outlet 34. The conveyor means also includes a driven feed screw 40 adjacent inlet 32, more specifically upper flight 38 for separating containers moving along a path and delivering the containers in a synchronized spaced relation. The drive means for feed screw 40 will be described in more detail hereafter.

Containers 30 are received into a helical groove 41 defined on feed screw 40 and are moved past lubricating or waxing station 22 where a lubricant is applied to a portion of the container, as will be described later.

The lubricated containers are then delivered to a first transfer wheel 42 having a plurality of container receiving pockets 44 on the periphery thereof which have a predetermined spacing to maintain the spacing between adjacent containers 30. First transfer wheel 42, forming part of the conveyor means, is supported for rotation about a vertical shaft 46 that is rotated on frame 20 in a manner that will be described later. A peripheral guide 48 extends around a portion of the periphery of transfer wheel or star wheel 42 to maintain containers 30 within pockets 44. First transfer wheel 42 delivers containers 30 to necking station 24 where the movement of the containers along the path is continued by the necking apparatus in necking station 24 as a necking operation is performed in a manner that will be described later.

The containers having the reducing neck on a free edge thereof are then received into pockets 50 of a second transfer wheel 52 and this transfer wheel moves the containers along the path from necking station 24 to flanging station 26. Again, suitable guide rails (not shown) may be provided to maintain containers 30 within pockets 50. The second transfer wheel or star wheel 52 again is supported for rotation about a fixed axis defined by a shaft 54 that is rotatably supported on frame 20 and is driven by power means that will be described later. The containers having the reducing neck on the upper free edge thereof are then received into the flanging apparatus located in flanging station 26 where the movement along the path is continued by the flanging apparatus as the flanging of the containers is performed.

The necked and flanged containers are then transferred to a third transfer wheel or star wheel 60 that again has a plurality of peripheral pockets 62 for receiving containers 30 and delivering the containers to upper flight 38 of endless belt 36 for movement through the outlet end 34 of the path. Star wheel or transfer wheel 60 is again supported on a shaft 64 that is rotated about a vertical axis on frame 20 through drive means that will be described later.

Preferably, the areas below the transfer wheels 42, 52 and 60 defining part of the path for the containers have hardened wear plates (not shown) that are vertically adjustable with respect to frame 20 so that the upper surfaces supporting the containers may be accurately vertically aligned with the container receiving elements in the necking and flanging stations.

Lubricant Applying Means 22

Figure 4:
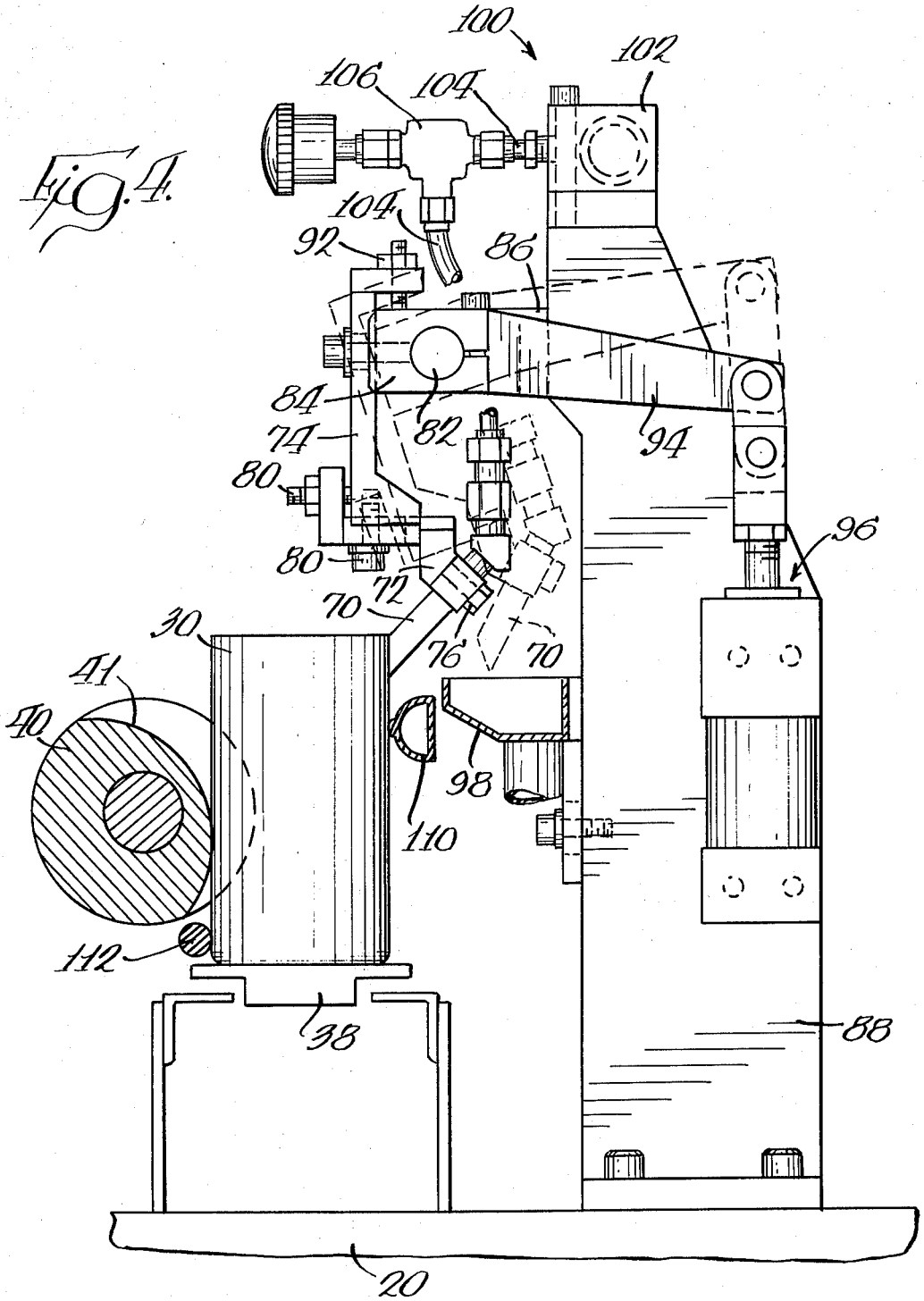
FIG. 4 is a vertical section of the lubricant applying means, as viewed along line 4—4 of FIG. 3.

The details of the lubricant applying means will best be understood with reference to FIGS. 1 and 4. Lubricant applying means 22 consists of a plurality of separate brushes 70, four being illustrated in FIG. 1, that are longitudinally aligned with each other adjacent one side of the path defined by upper flight 38 of endless conveyor 36. Each of the brushes 70 is supported in a holder 72 and the holders 72 are supported on arms 74. Preferably, brushes 70 are releasably held within holders 72 through bolts 76 so that the position of the brushes within holders 72 may be adjusted to accurately locate the free ends of brushes 70 with respect to the path. Also, holders 72 are vertically and horizontally adjustable on arms 74 through set screws 80.

The respective arms 74 are secured to a shaft 82 through a coupling block 84 and shaft 82 is supported for rotation about an axis parallel to the path for the containers by brackets 86 extending from an upright portion 88 carried on frame 20. Again, it is preferable that arms 74 be adjustable relative to block 84 by set screws 92. Shaft 82 has an arm 94 extending therefrom with a fluid ram 96 interposed between the outer end of arm 94 and upright 88. With this arrangement, extension and retraction of fluid ram 96 will rotate shaft 82 and move brushes 70 between the engaged position, shown in solid-line in FIG. 4 and the nonengaged position shown in dotted-line in FIG. 4. The advantage of such arrangement is that the brushes can readily be moved to the nonengaged or disengaged position should there be any interruption in the flow of containers moving along the path through the machine. In this nonengaged position, a trough 98 is positioned directly below brushes 70 so that any excess lubricant is collected by the trough and is returned to a lubricant reservoir (not shown).

Lubricant applying means also includes lubricant supply means 100 for continuously maintaining a supply of liquid lubricant or wax to the respective brushes 70. Lubricant supply means 100 consists of a manifold 102 that has a plurality of conduits 104 extending therefrom to each of the respective brushes 70. Each conduit 104 has a separate control valve 106 therein so that the respective conduits 104 and valves 106 act as separate means for supplying lubricant to the respective brushes 70.

Liquid lubricant is pumped from a reservoir (not shown) by a pump (also not shown) through manifold 102 and the necessary amount of liquid lubricant passes through the respective conduits 104 to the respective brushes 70. Any excess liquid lubricant is then returned to the reservoir for reuse.

The conveying means for moving the containers 30 along a path also include rotating means adjacent the lubricant applying means for rotating the containers relative to the lubricant applying means 22 to expose the entire upper peripheral edge portion of the container to the lubricant applying means. The rotating means at the lubricant applying station 22 consists of a fixed rail 110 that extends generally parallel to the upper flight 38 of the endless conveyor 36 and is located on one side of the path for the containers adjacent brushes 70. A movable rail in the form of an endless belt or O-ring 112 is located on the opposite side of the path for the containers 30 and is supported on a pair of pulleys 114 (FIGS. 1 and 3) with one of the pulleys being driven by a power source to be described later.

The necking and flanging apparatus also includes stop means for interrupting the motion of the containers at the inlet to the path. This stop means may be considered to be part of the lubricant applying means or station 22. The stop means is best illustrated in FIG. 3 and consists of a block 120 slidably supported in a guide 122 secured to frame 20. Block 120 is moved by a fluid ram 124 and engages a rail 126 located on one side of endless belt 32 with an opposite support rail 128 located on the opposite side. By extending fluid ram 124, the free end portion of guide rail 126 is moved towards guide rail 128 to interrupt the movement of containers 30 along the path defined by endless belt 36 at inlet 32. If desired, fluid rams 124 and 96 may be simultaneously actuated by the same fluid source so that the brushes 70 are automatically moved to the disengaged position shown in phantom line in FIG. 4 when the motion of the containers is interrupted by stop means 120.

Necking Station 24

Figure 5:
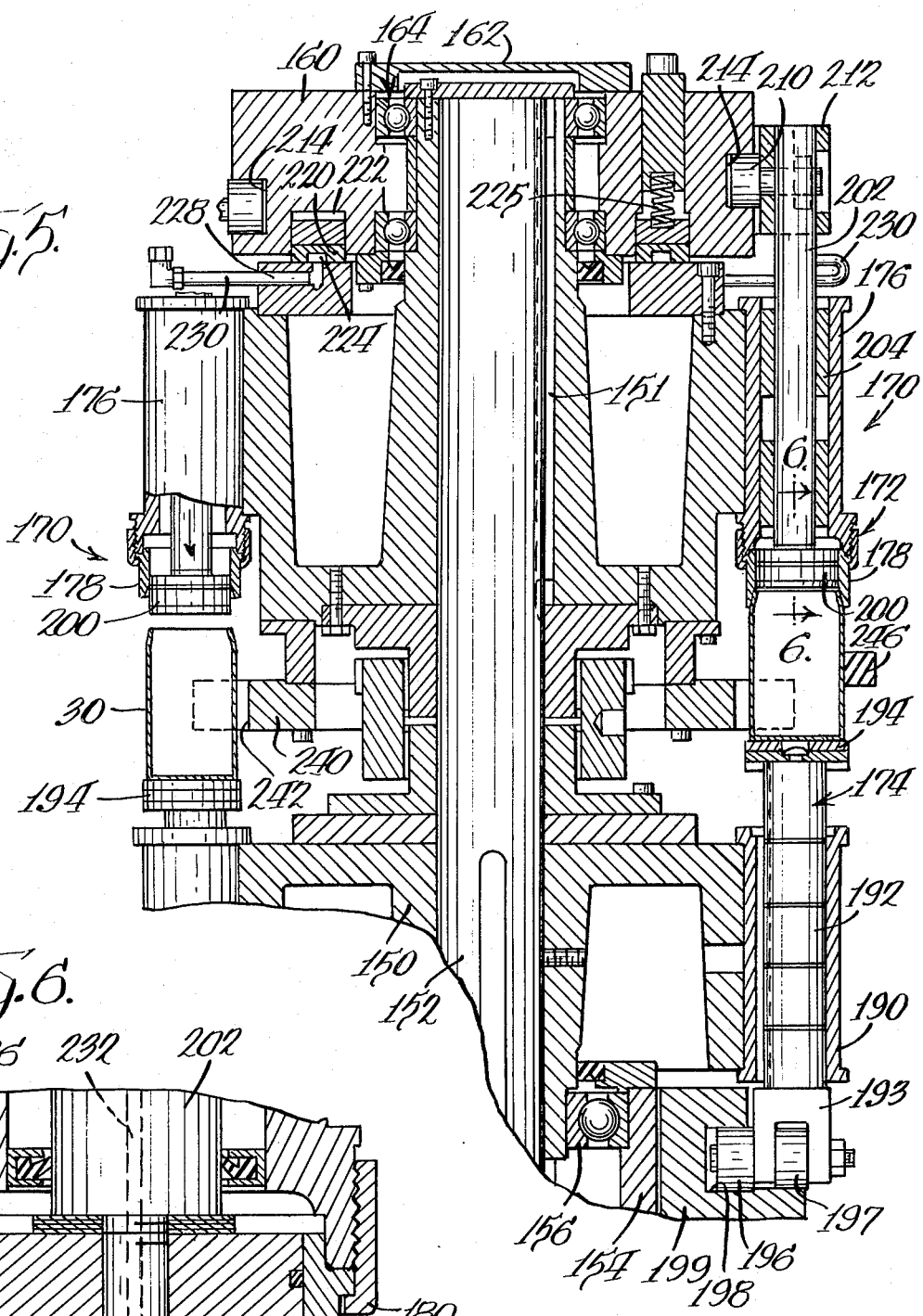
FIG. 5 is an enlarged fragmentary sectional view of the necking station of the apparatus.
Figure 6:
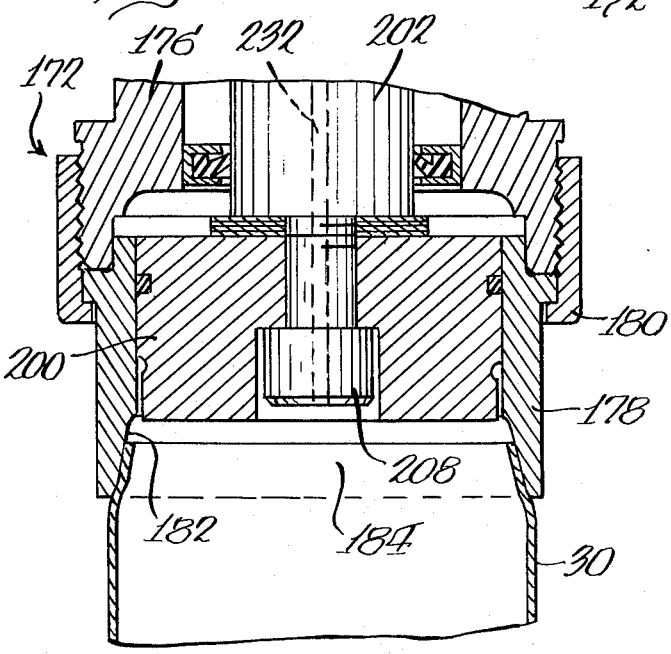
FIG. 6 is an enlarged fragmentary sectional view, as viewed along line 6—6 of FIG. 5.

The details of necking station 22 are most clearly illustrated in FIGS. 5 and 6. Necking station 24 consists of a necking turret 150 fixed by keys 151 to a shaft 152 that is supported on frame 20. Turret 150 and shaft 152 are supported for rotation about a vertical axis on frame 20 and, for this purpose, frame 20 has a hub portion 154 extending above the base portion with a bearing 156 interposed between hub 154 and turret 150 adjacent the lower end thereof. The upper end of turret 150 and shaft 152 are likewise supported for rotation about a fixed axis. In this instance, a circular member or plate 160 is fixedly secured to a bracket 162 extending between necking station 24 and flanging station 26 (see FIG. 3). Thus, for all purposes, plate 160 may be considered to be a part of rigid frame 20. Again suitable bearings 164 may be interposed between plate 160 and turret 150.

Turret 150 has a plurality of necking assemblies 170 (15 in number being illustrated) on the outer periphery thereof. Each necking assembly includes an upper member or deforming element 172 adapted to engage the outer peripheral surface of the upper edge portion of the container 30 and a lower member or platform 174 adapted to engage the bottom wall of the container. Upper member 172 (FIG. 6) consists of a sleeve 176 that is fixedly secured to the periphery of turret 150 with an annular necking flange or die 178 releasably secured to the lower end of sleeve 176 (FIG. 6). Annular necking die is preferably secured to the lower end of sleeve 176 by a cap 180, as shown in FIG. 6. The lower inner surface of annular die 178 has a necking surface 182 defined thereon which will ultimately result in producing the reducing neck on the upper peripheral edge portion 184 of container 30, as shown in FIG. 6.

Each necking assembly 170 also includes a lower sleeve 190 (FIG. 5) fixed to the periphery of turret 150 and vertically aligned with upper sleeve 176. Lower support member 174 consists of a shaft 192 reciprocated within sleeve 190 with a platform 194 secured to the upper end of shaft 192. A cam 196 is fixedly secured to the lower end of shaft 192 through a cam block 193 and is received into an annular groove 198 which defines a camming surface on cam plate 199 that is fixedly secured to the periphery of hub 154. Camming surface 198 is configured to move upper platform 194 between lower and raised positions, respectively shown on the left-hand and right-hand sides of FIG. 5, during each revolution of turret 150. A further roller 197 is aligned with the axis of shaft 192 and is rotated about an axis common with the axis for roller 196. Roller 197 provides positive support to shaft 192 on frame 20. Stated another way, cams 196 and 197 on the respective shafts 192 and camming surface 198 on frame 20 define means at the necking station for producing relative vertical movement between the upper necking member or annular die 178 and the lower support member or platform 194 to produce a reducing neck on the free edge portion of the container supported therebetween.

Each necking assembly 170 also has means for removing the container with a reducing neck from annular die 178. This means is again most clearly illustrated in FIGS. 5 and 6 and consists of a plug 200 that is secured to the lower end of a shaft 202, which is reciprocated within sleeve 176 with suitable bearing means 204 interposed between the sleeve and shaft. Plug 200 is preferably releasably retained on shaft 200 by screw 208. The upper end of shaft 202 has a cam 210 secured thereto through a cam block 212 with cam 210 extending into a camming surface 214 defined on the outer periphery of plate 160, which forms part of frame 20. Camming surface 214 has substantially the identical configuration to camming surface 198 except that camming surface 214 is circumferentially offset with respect to surface 198 so that the plug or knock-out punch 200 trails the downward movement of support platform 194.

Again, camming surface 214 is configured so that plug or knock-out punch 200 is moved between raised and lowered positions respectively shown on the right and left-hand sides of FIG. 5 during each revolution of turret 150.

The means for removing containers 30 from annular die 178 also includes means for supplying air under pressure into the containers as platform 194 is moved away from annular die 178. The means for supplying air consists of a ring 220 received in an annular slot 222 in plate 160 with ring 220 having an annular groove 224 extending around a predetermined circumferential dimension of the ring. An upper plate 226 secured to the upper edge portion of turret 150 has an upper surface in contacting engagement with adjacent surface on ring 220 to provide a substantially fluid tight seal between the two surfaces. This contacting engagement may be enhanced by springs 225 interposed between ring 220 and plate 160. Plate 226 has a plurality of circumferentially spaced openings 228 that are adapted to be in communication with annular groove 224 during rotation of turret 150 with respect to fixed plate 160 forming part of frame 20. Openings 228 are respectively connected by conduits 230 to axial openings 232 extending through shaft 202 as well as screw 208 releasably retaining plug 200 on the lower end of shaft 202. Thus, whenever openings 228 are aligned with partial annular groove 224, pressurized air that is supplied to annular groove 224 from a source (not shown) is delivered through axial openings 232 into the containers 30. This arrangement has two distinctive advantages in that the pressurized air acts as a means for removing containers 30 from annular die 178 and the pressurized air also acts to insure that the containers remain supported on platforms 194 during the descent of the platform since the air under pressure will produce a positive downward force onto the bottom wall of the containers.

The pressurized air acts as the primary means for removing the containers from annular die 178. However, should one of the containers remain on annular die 178 after platform 194 begins its descent, the plug, which is positively driven by cooperating camming surface 214 and cam 210 will insure that the container is removed from annular die 178.

Necking turret 150 also has a star wheel 240 secured thereto with the star wheel having a plurality of circumferential pockets 242 that are respectively vertically aligned with each of the necking assemblies 170. The annular surfaces defining pockets 242 are arranged and configured so that a container will be positively transferred from the transfer wheel 42 in accurate alignment with annular dies 178 in the overlapping area between turret 150 and transfer wheel 42.

Necking station 24 also has a guide rail 246 (FIG. 3) extending around a peripheral portion of turret 150 to further insure that the containers 30 are positively held on support platforms 194 in accurate alignment with annular dies 178.

Flanging Station 26

Figure 7:
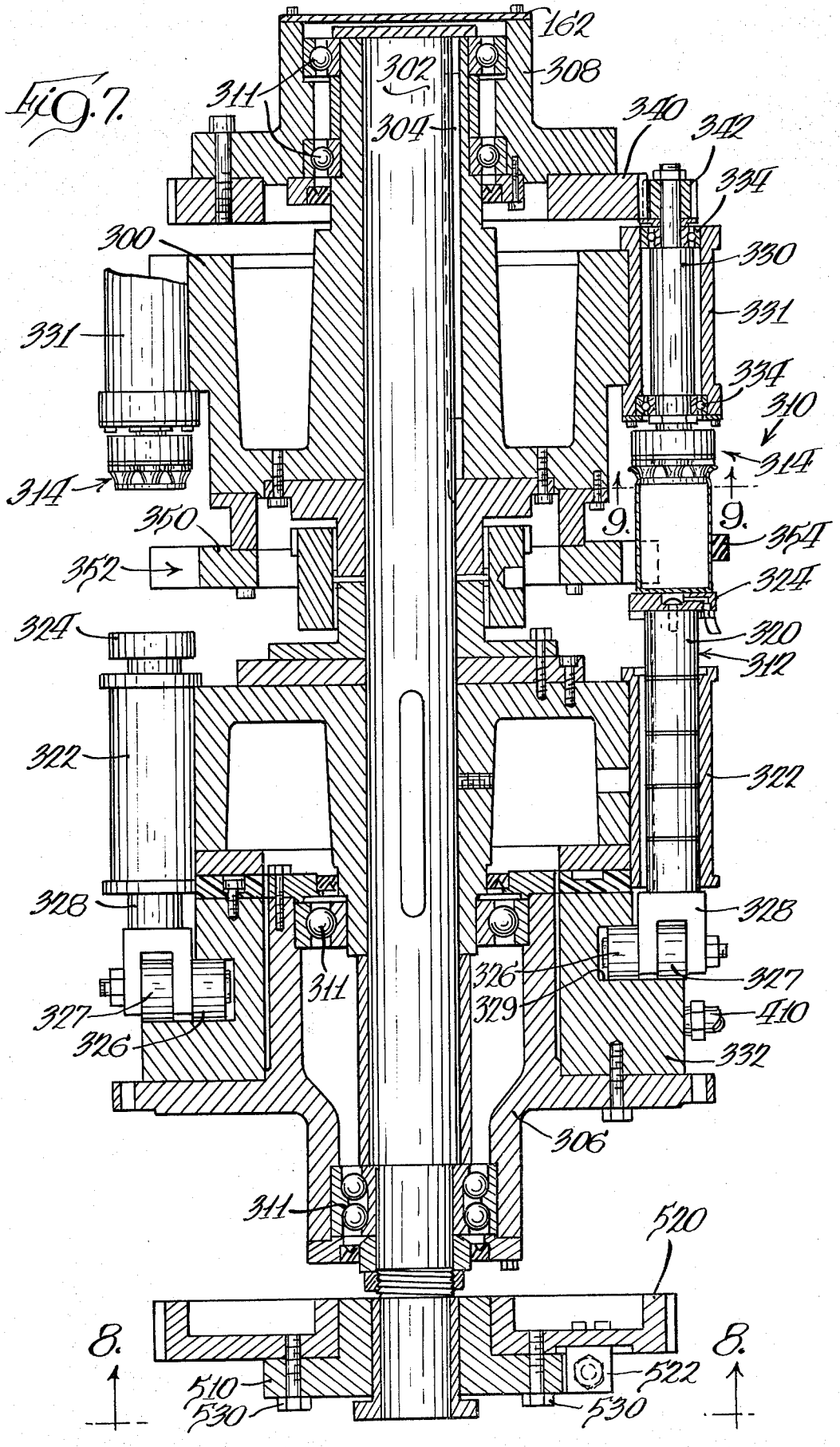
FIG. 7 is a sectional view of the flanging station of the apparatus.
Figure 7A:
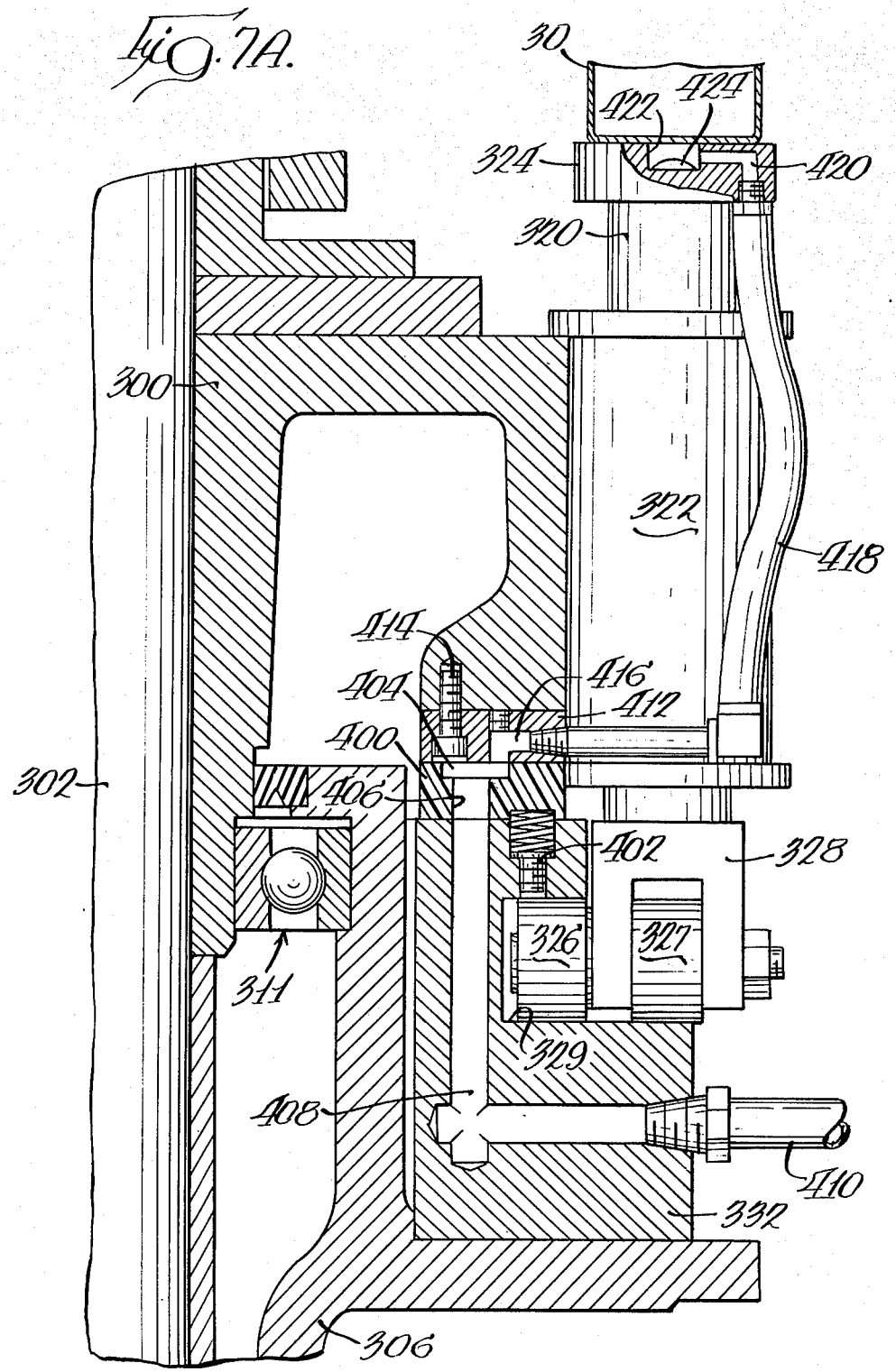
FIG. 7A is an enlarged fragmentary section view of a portion of the flanging station.

Flanging station 26 is most clearly illustrated in FIGS. 7 and 7A and in many respects is similar to necking station 24 so that many of the various parts are interchangeable.

Flanging station 26 consists of a turret 300 that is fixedly secured to shaft 302 through suitable keys 304 or other securing devices so that the shaft and turret 300 rotate as a unit. Turret 300 and shaft 302 are again supported for rotation about a vertical fixed axis on frame 20 and for this purpose, frame 20 has a lower hub portion 306 that is fixedly secured to base plate forming part of frame 20 and an upper hub 308 that is fixedly secured to plate 162 (FIG. 3). Suitable bearings 311 may be interposed between turret 300 and hubs 306, 308. Flanging turret 300 has a plurality of flanging assemblies 310 each of which are identical in construction. Each flange assembly 310 consists of a lower support member 312 and an upper flanging member 314. Lower support member 312 is identical in construction to lower support member 174 in necking assembly 170, except for the vacuum system, to be described later. To reiterate, lower support member 312 consists of a shaft 320 reciprocated within a lower sleeve 322 with a support platform 324 secured to the upper end of shaft 322. The lower end of shaft 322 has cams 326, 327 secured thereto through a cam block 328 with cams 326, 327 riding in a camming surface 329 that is defined on a member 332 which forms part of frame 20. Camming surface 329 is again configured to move platform 324 between the lowered and raised positions, respectively shown in the left and right-hand sides of FIG. 7, during each revolution of turret 150.

Upper flanging member 314 also consists of a shaft 330 that is rotatably supported in a fixed sleeve 331 that is vertically aligned with lower sleeve 322 and is fixedly secured to the periphery of turret 300. Suitable bearings 334 are interposed between sleeve 332 and shaft 330. Bearings 334 support shaft 330 for rotation about a fixed axis defined within sleeve 332. Rotational movement of shaft 330, which forms part of upper flanging member 314, is produced by a fixed gear 340 secured to upper hub 308 with a plurality of gears 342 respectively secured to shafts 330 and in mesh with gear 340. Thus, rotation of turret 300 with respect to fixed hub 308 and fixed gear 340 will cause rotation of upper flanging members 314 within sleeves 332.

As was true with respect to necking station 24, flanging station 26 also has a star wheel 350 secured to turret 300 with pockets 352 aligned with the respective sleeves 322, 332 and a peripheral rail 354 so as to positively receive containers from transfer wheel 52 and hold them on support platforms 324.

Figure 9:
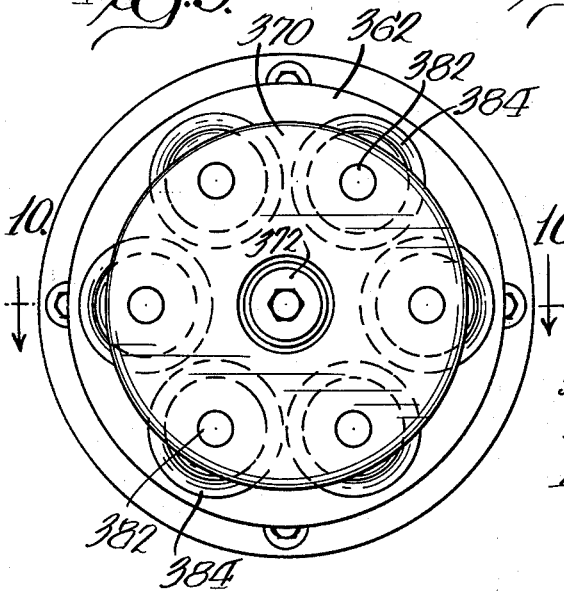
FIG. 9 is an enlarged bottom view of the lower end of the flanging member with the container deleted, as viewed along line 9—9 of FIG. 7.
Figure 10:
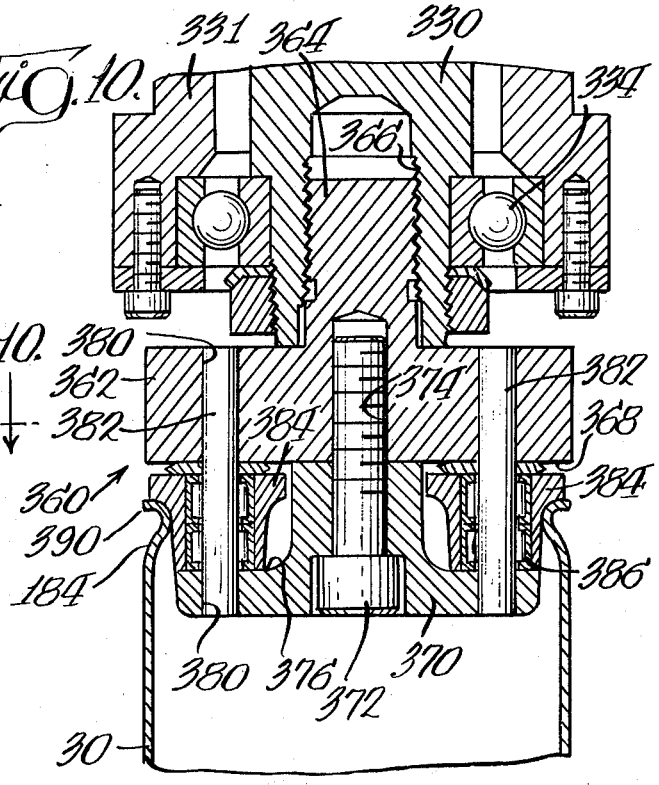
FIG. 10 is an enlarged transverse sectional view as viewed along line 10—10 of FIG. 9.

According to one aspect of the invention, the upper flanging member is of unique design in that it consists of freely rotatable rollers that are supported in a particular manner to insure the free rotation of the rollers at all times. Referring particularly to FIGS. 9 and 10, the lower end of flanging member 314 consists of a flanging head 360 that is removably secured to the lower end of shaft 330. Flanging head or deforming element 360 consists of a circular plate 362 that has a threaded hub 364 integral with one surface thereof and threadedly received into a threaded opening 366 in the lower end of shaft 330. Upper plate 362 has a lower flat surface 368. A lower cap or plate 370 is releasably secured to upper plate 362 through a stud 372 threaded into an opening 374 in upper plate 362. The hub or lower plate 370 has a second surface 376 that extends parallel to surface 368. Plates 362 and 370 have a plurality of apertures 380 at circumferentially spaced locations vertically aligned with each other. Each of the aligned pairs of apertures has a pin 382 received therein and the respective flanging rollers 384 are freely rotated on pins 382 with suitable bearing structure 386 in between. Thrust bearings 388 are located between surface 368 and rollers 384.

As can be seen from an inspection of FIG. 9, flanging head 360 has six (6) flanging rollers 384 supported between spaced plates 362 and 370 and freely rotatable on pins 382. The peripheral surfaces of rollers 384 are specifically configured to result in producing an outwardly directed peripheral flange 390 on the reducing neck portion 184 of container 30. The advantage of the specific configuration of the flanging head 360 is that the rotational axis of the rollers, defined by pins 382 is held in a fixed position on both ends of rollers 384 to insure the free rotation thereof at all times. Furthermore, adequate spacing can always be developed between the rollers and the adjacent supporting surfaces by providing suitable shims or other spacers between plates 362 and 370.

As is true with respect to the necking apparatus, the flanging apparatus also incorporates means for removing the containers from the flanging head 360. In the flanging apparatus, this means is in the form of a vacuum system cooperating with support platforms 324. The vacuum system also has a second distinct advantage in that it supports the containers with respect to platforms 324 to prevent relative rotation thereof during the flanging operation.

The details of the vacuum means are shown in FIG. 7A and include an annular half circle nylatron ring 400 spring bolted to the top surface of cam 332 by bolts 402. Ring 400 has a slot 404 of predetermined length in the upper surface thereof and has an opening 406 therein in communication with slot 404. The opposite end of opening 406 communicates with an opening 408 in cam 332 and a vacuum source is connected to opening 408 through conduit 410.

The vacuum system also includes a steel ring 412 secured to a lower surface of turret by bolts 414. Ring 412 has fifteen cross drilled openings 416 therein that are radially aligned with slot 404. Each opening 416 has a conduit 418 connected thereto and an opposite end of each conduit is connected to an opening 420 in a platform 324. The respective openings 420 in platforms 324 communicate with a recess 422 that is provided in platforms 324 for receiving bolts 424 that hold platforms 324 on shafts 320.

Thus, when openings 416 are aligned with slot 404 a vacuum is developed in recesses 422 to securely hold containers 30 on platforms 324. Arcuate slot 404 is configured so that a vacuum is developed in each recess 422 during the portion of turret rotation where the flanging operation is performed and also during a portion of the descent of platform 324 away from flanging head 360 to insure that the container is stripped from the flanging head, e.g. lowers with the platform.

Drive Means

According to one aspect of the invention, all of the transfer wheels as well as the turrets are driven from a common source to substantially simplify the required synchronized motion of the containers through the generally sinusoidal path defined by the conveyor means.

More specifically, the drive means consists of a single drive motor 500 that has a pulley 502 on an output shaft 504 connected to a further pulley 506 on a drive shaft 508 through a conventional V-belt 509. Shafts 46, 54, 64, 152 and 302 are all positively driven in synchronized relation by the single input shaft 508. For this purpose, input shaft 508 has one or more gear boxes (not shown) associated therewith so that the input to shaft 508 is capable of being applied directly to the respective shafts on the transfer wheels and the turrets.

Figure 8:
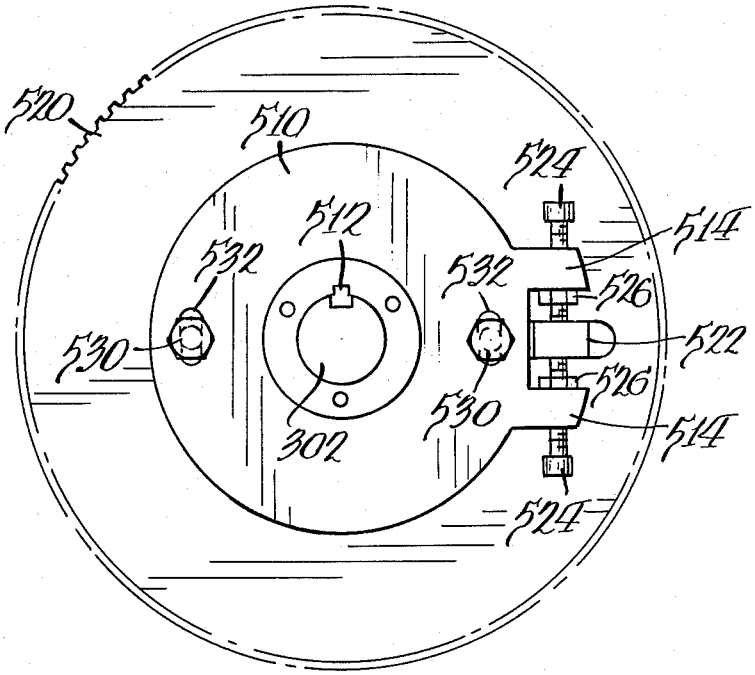
FIG. 8 is a bottom view of the flanging station, as viewed along line 8—8 of FIG. 7.

The shafts on the turrets as well as the transfer wheels each have a driven gear secured thereto and the circumferential position of the gear with respect to the shaft can be accurately adjusted through adjustment means that will now be described. Since all of the gears and the respective adjustment means for the shaft are substantially identical in construction, only one will be described and the flanging turret shaft 302 will be used as exemplary for defining the drive mechanism. As shown in FIGS. 7 and 8, shaft 302 has a hub 510 secured thereto through the usual key and slot 512. The lower periphery of hub 510 has a pair of ears 514 extending therefrom at circumferentially spaced locations to define a space therebetween. A gear 520 is supported on hub 510 and has an ear 522 extending therefrom and positioned between the spaced ears 514 on hub 510. A pair of adjusting screws 524 are respectively threaded through openings in ears 514 and engage opposed surfaces of ear or member 522 extending from gear 520. The respective screws 524 have locking nuts 526 located thereon for defining a fixed position for the screws with respect to ears 514. In addition, hub 510 and gear 520 are capable of being locked in an adjusted position with respect to each other by a plurality of screws 530 threaded into openings in gear 520 and extending through arcuate slots 532 defined in hub 510.

Thus, by proper selection of the size of the respective gears on the respective shafts 46, 54, 64, 152 and 302, a general synchronized driving relation can be produced so that the peripheral speed of the respective transfer wheels 42, 52 and 62 is accurately correlated with the peripheral speed of the turrets 150 and 300. Furthermore, accurate final adjustments of the circumferential position of the respective gears on the respective shafts can be made by loosening screws 530 and lock nuts 526 and producing the appropriate direction of rotation of set screws 524 so as to change the circumferential positioning of hub 510 with respect to gears 520.

The drive means for feed screw 40 again consists of a gear box 560 (FIG. 2) driven by shaft 508 and connected by a belt 562 to an input shaft 564 (FIG. 1). Shaft 564 is connected to feed screw 40 by a spherical knob with pins that engage a slot in the end of feed screw 40, all of which are located in box 566, so that feed screw 40 is driven directly from input shaft 508 and feed screw 40 can be axially adjusted relative to the path.

In addition, moving rail or O-ring belt 112 is also driven from shaft 564 through V-belt 562 that is entrained over a pulley 570 connected to a shaft 572, which in turn is connected directly to one of the pulleys 114. With this arrangement, the input feed screw can be correlated with the speed of motion of the respective transfer wheels and turrets so that containers are moved along the continuous path in a positive manner without any interference.

Thus, by proper selection of the sizes of the transfer wheels, as well as the star wheels on the turrets, and proper selection of an equal number of pockets on the respective transfer wheels as well as necking and flanging assemblies on the respective turrets (fifteen such pockets and assemblies being illustrated), accurate and controlled transfer of the containers can be maintained throughout the path of movement of the container from the inlet end of the apparatus to the outlet end.

The remainder of the drive mechanism for endless conveyor 36 could likewise be through the same common drive shaft 508. However, for purposes of simplicity, in the illustrated machine, the drive for conveyor 36 is through a separate motor connected to the respective driven elements. As shown in FIGS. 1 and 3, the drive for endless conveyor 36 defining inlet 32 and outlet 34 for the path includes a separate motor 580 having a gear box 582 at the output thereof connected through a chain 584 to a drive pulley 586 on one end of endless belt 36. Thus, the speed for endless belt 36 can be independently controlled so that the speed of the containers leaving the necking and flanging apparatus can be correlated with a subsequent operation on the container.

OPERATION

The overall operation of the waxing, necking and flanging apparatus constructed in accordance with the teachings of the present invention will now be described and the method of the present invention will also be correlated with the operation of the apparatus.

Initially, the various adjustments are made so that all of the transfer wheels and the turrets are synchronized, resulting in the pockets of the star wheels, connected to the necking turret and the flanging turret, being vertically aligned with the respective pockets on the transfer wheels at the points of transfer of the containers between the respective wheels. In addition, the speed of rotation of feed screw 40 is correlated so that a container is delivered to first transfer wheel 42 as each of the pockets 44 is aligned with the peripheral or spiral groove 41.

The various motors, pumps, and pressurized air and vacuum sources are then actuated and a continuous supply of containers 30 is delivered through inlet 32. Each container is picked up in appropriate timed and spaced relation by feed screw 40 and is moved past brushes 70 for applying the liquid lubricant or wax to the upper peripheral edge portion of the container. During this motion past brushes 70, O-ring belt 112, acting as a movable rail will simultaneously rotate the containers about their vertical axes to insure that the entire periphery of the upper edge portion of the container is appropriately lubricated. Preferably, the rotation is such that the container is rotated substantially more than one revolution as it is moved past the various brushes 70.

The appropriate spacing between respective containers is subsequently maintained throughout the continuous path of movement of the containers from inlet end 32 to outlet end 34 of the path as will be apparent from the above description. The appropriately spaced containers 30 are then delivered into the respective pockets 44 of the rotating first transfer wheel 42 and are moved along the arcuate periphery thereof defined by guide rail 48. As the containers reach the juncture between first transfer wheel 42 and necking turret 150, the containers are positively picked up by the respective pockets 242 on star wheel 240, which forms part of turret 150, and are positioned or centered with respect to platforms 194.

After being positioned on platforms 194, the continued movement of the containers along the path is produced by the rotational movement of the necking turret. During this rotational movement of the necking turret, the lower support member 174 is moved vertically with respect to upper fixed die element 178 to force the upper peripheral edge portion 184 of the respective containers 30 into the annular die 178 and produce the reducing neck that is shown in FIG. 6. After the reducing neck has been produced on the containers, the support members 174 are again lowered by appropriate configuration of camming surface 198 and, simultaneous to this motion, pressurized air is supplied through conduits 230 and axial openings 232 to force the containers from annular dies 178. To further insure that the containers do not stick within annular dies 178, knock-out punch 200 is positively driven between raised and lowered positions shown in FIG. 5 by camming member 210 operating in camming surface 214.

After the necking operation, the containers with reducing necks are received into pockets 50 of second transfer wheel 52 to be delivered to the flanging turret and the containers are again positively moved onto platform 324 by transfer wheel or star wheel 350 having peripheral container receiving pockets 352 connected to turret 300. As the lower flanging members 312 are raised, a vacuum is developed in recess 422 to positively hold the containers on support platform 324. During this time, the containers are continuing their motion along the path, which at this time is defined along the periphery of flanging turret 300. When the flanging operation is completed, the containers having a reducing neck and peripheral outwardly directed flange are then transferred by the third transfer wheel or star wheel from flanging turret directly on to endless conveyor 36 and towards outlet end 34 of the path for the containers. It will be appreciated that during the entire movement of the containers between inlet 32 and outlet 34, the axes of the respective containers extend generally vertically and the containers are at all times under positive control by some driven member and are spaced from each other to prevent any possible damage, such as denting, while they are moving through the waxing, necking and flanging apparatus.

SUMMARY

As can be appreciated from the above description, the present invention provides a simple compact machine for producing accurate movements of containers along a predetermined path and simultaneously waxing the peripheral surface of the upper edge portion of the containers, producing a reducing neck on the containers, and subsequently producing an outwardly directed flange on the peripheral edge portion. All of this is accomplished in an extremely compact machine that requires substantially less floor space than was heretofore necessary for performing the various operations in separate machines.

Of course, it will be appreciated that various modifications will come to mind without departing from the spirit of the present invention.

What is claimed is:

1. Apparatus for producing a reduced neck and a peripheral flange on a free edge portion of a container having a cylindrical body and an integral bottom wall comprising: a fixed frame; inlet conveyor means on said frame for receiving said containers in a vertical position and simultaneously rotating and moving said containers in a generally horizontal direction; lubricant applying means on said frame adjacent said inlet conveyor means for applying lubricant to an outer surface of said free edge portions; first transfer means for receiving the lubricated containers from said inlet conveyor means and transferring said containers to a necking station; a necking turret rotated about a vertical axis on said frame at said necking station, said turret having a plurality of necking assemblies on the periphery thereof, each necking assembly including an upper necking member and a lower support member; means at said necking station for producing relative vertical movement between said upper necking member and said support member to produce a reducing neck on said free edge portion of a container; second transfer means on said frame for receiving containers from said necking station and transferring said containers to a flanging station; a flanging turret rotated about a vertical axis on said frame at said flanging station, said flanging turret having a plurality of flanging assemblies on the periphery thereof, each flanging assembly including a lower member and an upper flanging member; means at said flanging station for simultaneously rotating said flanging member and producing vertical movement between said flanging member and said lower member; common drive means for said first and second transfer means and said turrets for producing synchronized movement of said containers; and outlet conveyor means on said frame for receiving containers from said flanging station.

2. Apparatus as defined in claim 1, in which said lubricant applying means including a plurality of brushes spaced along said path with means for supplying lubricant to said brushes.

3. Apparatus as defined in claim 2, further including means for supporting said brushes for movement transversely of said path between engaging and disengaging positions.

4. Apparatus as defined in claim 3, in which said means for supporting said brushes includes a member pivoted about an axis extending generally parallel to said path and means for pivoting said member.

5. Apparatus as defined in claim 1, in which said inlet conveyor means includes a moving support member supporting the bottom walls of said containers, a fixed rail adjacent said lubricant applying means for engaging said cylindrical body and a moving rail spaced from said fixed rail for engaging said cylindrical body opposite said fixed rail.

6. Apparatus as defined in claim 1, in which each necking assembly includes a lower sleeve on said necking turret with said lower support member reciprocated in said sleeve.

7. Apparatus as defined in claim 6, in which said means at said necking station for producing relative movement includes a camming surface fixed with respect to said frame and cam means on said lower support members engaging said camming surface.

8. Apparatus as defined in claim 6, in which each upper necking member has an annular necking die fixed to said necking turret for engaging an outer surface of said free edge portion for producing said reducing neck.

9. Apparatus as defined in claim 8, further including means for removing said free edge portion of said containers from said annular necking die.

10. Apparatus as defined in claim 9, in which said means for removing said free edge portion includes means for supplying fluid under pressure through said upper necking members.

11. Apparatus as defined in claim 9, in which said means removing said free edge portion includes a plug reciprocable in said annular necking die for forcing a container from said annular die.

12. Apparatus as defined in claim 1, in which each of said transfer means includes a star wheel rotated about a vertical axis on said frame with said star wheels having peripheral container receiving pockets.

13. Apparatus as defined in claim 1, in which each flanging member includes a shaft rotatable about a fixed axis on said turret, spaced plates on the ends of said shafts defining spaced surfaces and freely rotatable flanging rollers supported on pins extending between said surfaces.

14. Apparatus as defined in claim 13, in which each flanging assembly includes upper and lower aligned sleeves on said flanging turret with said shafts respectively rotated in said upper sleeves and said lower members reciprocated in said lower sleeves and in which said means at said flanging station for simultaneously rotating said flanging member and producing vertical movement between said flanging member and said lower member includes a first gear fixed to said frame at said flanging station and a second gear on each shaft in mesh with said first gear for rotating said shafts in said sleeves in response to rotation of said flanging turret on said frame.

15. Apparatus as defined in claim 14, in which the means for producing vertical motion includes a camming surface fixed to said frame and a cam on each lower member in engagement with said camming surface.

16. Apparatus as defined in claim 13, further including vacuum means in each of said lower members for holding said containers on said lower members.

17. Apparatus for producing a reduced neck and a peripheral flange on a free edge portion of a cylindrical container having a cylindrical body and an integral bottom wall, comprising a fixed frame; conveyor means on said frame defining a generally horizontal path for the containers and supporting the containers with the axis of the container body extending generally vertically and the free edge portion located above the conveyor means; lubricant applying means on said fixed frame adjacent said conveyor means and vertically positioned to engage said free edge portion; rotating means adjacent said lubricant applying means for rotating said containers relative to said lubricant applying means to expose the entire peripheral edge portion to said lubricant applying means; necking means along said path for producing a reducing neck on said free edge portion, said necking means including an upper member for engaging an outer surface of said edge portion, a lower member for engaging said bottom wall and means on said frame for producing relative vertical motion between said upper and lower members; flanging means on said frame along said path for producing an outwardly directed flange on the free edges of said reducing necks, said flanging means including an upper flanging member having a plurality of freely rotating rollers supported thereon for engaging an inner surface of said reducing neck, a lower member for engaging said bottom wall and means for producing relative rotation and vertical movement between said upper and lower flanging members.

18. Apparatus as defined in claim 17, in which said lubricant applying means includes a plurality of individual brushes aligned with said path and separate means connected to the respective brushes for supplying lubricant thereto.

19. Apparatus as defined in claim 18, in which said rotating means includes a fixed rail on one side of said path adjacent said brushes and a movable rail on an opposite side of said path for producing engagement and rotation of the containers relative to said path.

20. Apparatus as defined in claim 17, in which said necking means includes a necking turret rotated about a vertical axis on said frame, said necking turret having a plurality of upper and lower vertically aligned sleeves with a necking die defining said upper member secured to each upper sleeve and a lower member reciprocated on each lower sleeve and in which said means for producing relative vertical movement includes cam means between said frame and said lower members.

21. Apparatus as defined in claim 20, in which said flanging means includes a flanging turret rotatable about a fixed vertical axis with a plurality of upper and lower aligned sleeves on the periphery of the flanging turret, each upper sleeve having an upper flanging member rotated therein and each lower sleeve having a lower flanging member reciprocated therein and in which said means for producing relative rotation and vertical movement between said flanging members includes a fixed gear and a camming surface on said frame, a gear on each upper flanging member in mesh with said fixed gear, a camming member on each lower flanging member engaging the camming surface with said camming surface being configured to move said lower flanging members between raised and lowered positions during each revolution of said flanging turret.

22. Apparatus as defined in claim 21, in which said conveyor means includes a first transfer wheel having pockets on the periphery thereof for receiving lubricated containers and delivering said containers in synchronized relation to said necking turret and a second transfer wheel between said necking turret and said flanging turret for transferring containers in synchronized relation between said turrets, a single drive means for said turrets and transfer wheels and adjustable means between said drive means on each turret and transfer wheel adjustable to maintain a synchronized relation between said turrets and said wheels.

23. Apparatus as defined in claim 22, in which said conveyor means includes an endless belt having an upper flight defining an inlet to said path adjacent said lubricant applying means with said first transfer wheel positioned to receive containers into said pockets from said upper flight, said upper flight also defining an outlet for said path, said conveyor means further including a third transfer wheel having peripheral pockets, said third transfer wheel being rotated about a fixed vertical axis on said frame and positioned to receive containers from said flanging turret and deliver the containers to said upper flight adjacent said outlet for said path.

24. Apparatus as defined in claim 23, in which said conveyor means includes a driven feed screw along said upper flight adjacent said inlet for separating containers and delivering said containers in synchronized relation to said first transfer wheel, said feed screw being driven by said single drive means.

25. Apparatus as defined in claim 24, in which said lubricant applying means includes a plurality of brushes along said path and said rotating means includes a fixed rail adjacent said brushes on one side of said path and a driven belt on the opposite side of said path.

26. Apparatus as defined in claim 25, further including means adjacent said path at said inlet actuatable to interrupt the movement of containers on said upper flight.

27. Apparatus as defined in claim 20, further including a plunger reciprocated in each upper sleeve and necking die and cam means between said frame and said plungers for reciprocating said plungers and forcing said containers from said dies.

28. A method of producing a neck and a peripheral flange on a free peripheral edge portion of a cylindrical container body comprising the steps of moving the container bodies along a generally horizontal path with the elongated axis of the container bodies extending vertically and the free peripheral edge portion above said path, positioning a lubricant applying member adjacent said path in vertical alignment with said edge portion for engagement therewith, rotating the container while moving along said path to apply lubricant on the outer surface of the entire peripheral edge portion, continuing movement of said containers along the path to a necking station, producing relative vertical movement between a support member located adjacent the bottom of said containers and an annular die above said containers to engage the outer surface of the peripheral edge portion and produce a neck of reducing diameter while continuing movement of the container along the path, moving the container to a flanging station, supporting the bottom of the container and engaging the inner surface of the neck of reducing diameter with freely rotating rollers on a rotating spindle to produce an outwardly directed flange on the peripheral edge portion.

29. A method as defined in claim 28, in which said necking station has a necking turret rotated about a vertical axis and a portion of the periphery of the necking turret defines a portion of the path and in which the necking turret has a plurality of necking dies and support members on the periphery thereof for receving respective containers.

30. A method as defined in claim 29, in which the annular dies are fixed on said necking turret and the support members are cammed towards and away from the fixed annular dies to produce the relative vertical motion.

31. A method as defined in claim 30, in which the containers are forced towards the support members while the support members are cammed away from the fixed annular dies.

32. A method as defined in claim 28, in which the containers are maintained in synchronized, spaced relation along the path between the inlet and outlet.

33. A method as defined in claim 28, in which the flanging station has a flanging turret rotated about a fixed vertical axis and a portion of the periphery of the flanging turret defines a portion of the path and in which the flanging turret has a plurality of flanging assemblies defined on the periphery thereof with each flanging assembly having a lower support member reciprocated parallel to the flanging turret axis towards and away from the rotating spindle.

34. A method as defined in claim 28, in which the lubricant applying member is a brush having lubricant supplied thereto, further including supporting the brush for pivotal movement adjacent the path between engaged and disengaged positions.

35. A method of producing a reducing neck and an outwardly directed flange on a free edge portion of a cylindrical container body comprising the steps of moving container bodies toward an inlet of a horizontal path, producing a predetermined spacing between adjacent container bodies adjacent the inlet, positioning a lubricant applying member adjacent the path, vertically aligned with the free edge portions of the container bodies, rotating the container bodies past the stationary lubricant applying member while moving the container boides along the path and maintaining the predetermined spacing, continuing the movement of the container bodies along the path while maintaining the predetermined spacing to a necking station having a necking turret rotated about a fixed vertical axis with a plurality of necking assemblies circumferentially spaced on the periphery thereof, delivering successive container bodies onto lower supporting members forming part of the respective necking assemblies, raising the respective support members to force the free edge portions into annular necking dies located above the support members, lowering the support members while forcing the container bodies toward the support members, transferring the container bodies from the necking station to a flanging station while maintaining the predetermined spacing, delivering the containers to lower support members on the periphery of a flanging turret rotated about a fixed vertical axis and having flanging members rotating thereon above the respective supporting members, raising the flanging support members on the rotating flanging turret to force the free edge portions of the container bodies into engagement with the flanging members, lowering the flanging support members, and removing the container bodies from the flanging support members and delivering the container bodies to an exit of the path.

36. Apparatus for applying lubricant to upper peripheral edge portions of container boides comprising conveyor means for moving the container bodies along a path, said conveyor means including mechanism for maintaining a predetermined spacing between adjacent container bodies; brush means along one side of said path positioned to engage the peripheral edge portions of the container bodies; means for supplying lubricant to said brush means; a fixed rail located adjacent said one side of said path and positioned to engage the container bodies; and a driven endless belt on the opposite side of said path for engaging the container bodies to force the container bodies against said fixed rail and rotate the container bodies relative to said brush means.

37. Apparatus as defined in claim 36, further including means for supporting said brush means for movement towards and away from said path between first and second positions, and a trough located below said brush means in the second position.

38. Apparatus as defined in claim 36, in which said brush means includes a plurality of brushes spaced along said path and said supply means includes separate means connected to the respective brushes for supplying lubricant thereto.

39. Apparatus for producing a reducing neck on a free edge portion of a cylindrical container body comprising a frame; a turret supported for rotation about a fixed axis; a plurality of necking assemblies equally spaced on the periphery of said turret, each necking assembly including an annular die fixed to said turret, a sleeve aligned with said annular die and a container body support member reciprocated in said sleeve; means defining a camming surface on said frame adjacent said turret; and a cam on each of said support members engaging said camming surface, said camming surface being configured to move said support member towards and away from said annular dies during each revolution of said turret.

40. Apparatus as defined in claim 39, further including means for forcing the container bodies from said annular dies during the movement of said support members away from said dies.

41. Apparatus as defined in claim 40, in which the means for forcing the container bodies includes a plunger reciprocated in each annular die and cam means between said frame and said plungers for reciprocating said plungers.

42. Apparatus as defined in claim 40, in which said means for forcing said container bodies includes means for supplying air under pressure through said annular dies into said container bodies.

43. Apparatus for producicng an outwardly directed flange on a reducing neck portion of a cylindrical container body comprising a frame, a turret rotatable about a fixed vertical axis on said frame, said turret having a plurality of flanging assemblies equally spaced about the periphery thereof, each flanging assembly including upper and lower vertically aligned sleeves fixed to said turret, a container body supporting member reciprocated in each lower sleeve, a cam on the lower end of each container body supporting member; a camming surface on said frame supporting said cams and configured to move said supporting members between raised and lowered positions during each revolution of said turret, a spindle rotated within each of said upper sleeves, a plurality of freely rotatable flanging rollers rotated about fixed axes on the lower end of each spindle and adapted to engage an inner surface of the reducing neck portions, a gear fixed to said frame, and a gear fixed to each spindle and in mesh with said fixed gear to produce rotation of said spindles in said upper sleeves in response to rotation of said turret on said frame.

44. Apparatus as defined in claim 43, in which each spindle has a flanging head releasably secured to the lower end thereof, each flanging head including upper and lower plates defining spaced parallel surfaces extending substantially perpendicular to the axis of each spindle, a plurality of pins extending between said plates and being circumferentially spaced from each other and located a common distance from the axis for an associated spindle with a flanging roller rotatable on each pin.

45. Apparatus as defined in claim 43, further including vacuum means in each supporting member for maintaining said container bodies on said supporting members.

46. Apparatus for deforming a free edge portion of a container body comprising a frame, a turret supported for rotation about a fixed vertical axis on said frame, a plurality of deforming stations equally spaced about the periphery of said turret, each deforming station including upper and lower vertically aligned sleeves secured to said turret, a lower support member reciprocated in each lower sleeve and having a container body support platform on the upper end thereof, a cam roller on the lower end of each support member, a camming surface on said frame supporting all of said cam rollers and configured to move said platforms between lowered and raised positions during each revolution of said turret, and a deforming element carried by each upper sleeve and located in the path of movement of the free edge portions of container bodies supported on said platforms while said platforms are moved from the lower to the raised positions, and means at each deforming station for causing the container bodies to lower with the platforms when the platforms are moved from the raised to the lowered positions.

47. Apparatus as defined in claim 46, in which said deforming means includes an annular die fixed to the lower end of each upper sleeve for engaging an outer peripheral surface of the free edge portion of the container body.

48. Apparatus as defined in claim 47, in which said means cooperating with each upper sleeve includes a plunger reciprocated in each annular die, a cam roller on each plunger and a camming surface on said frame engaging each cam roller on each plunger and configured to move said plungers between raised and lowered positions during each revolution of said turret.

49. Apparatus as defined in claim 46, in which each deforming element includes a spindle supported in each of said upper sleeves, a gear fixed to the upper end of each spindle above said sleeves, a gear fixed to said frame and in mesh with said gears on said spindles to rotate said spindles in said sleeves during rotation of said turret, and freely rotatable flanging rollers on the lower end of each spindle for engaging an inner surface of the free peripheral edge portions of the container bodies.

50. Apparatus as defined in claim 46, in which said means cooperating with said sleeves includes means for supplying air under pressure through said sleeves into container bodies supported on said platforms.

* * * * *